US006851368B2

(12) United States Patent
Detmers et al.

(10) Patent No.: US 6,851,368 B2
(45) Date of Patent: Feb. 8, 2005

(54) ROTARY PRINTING PRESS HAVING A SWITCHABLE SPEED-CHANGE GEAR MECHANISM WITH PLANT GEARS

(75) Inventors: Andreas Detmers, Heddesheim (DE); Arno Jünger, Nussloch (DE); Jürgen Kreutzkämper, Sinsheim-Hoffenheim (DE); Sven Mader, Dielheim (DE); Christian Meier, Schriesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/231,809

(22) Filed: Aug. 29, 2002

(65) Prior Publication Data

US 2003/0041755 A1 Mar. 6, 2003

Related U.S. Application Data

(60) Provisional application No. 60/316,843, filed on Aug. 31, 2001.

(30) Foreign Application Priority Data

Aug. 29, 2001 (DE) ..... 101 43 038

(51) Int. Cl.[7] ..... B41F 7/02; B41F 7/12; B41F 13/24

(52) U.S. Cl. ..... 101/483; 101/142; 101/248; 101/217; 101/247

(58) Field of Search ..... 101/483, 142, 101/248, 217, 467, 335, 232, 183; 400/612

(56) References Cited

U.S. PATENT DOCUMENTS 3,594,552 A * 7/1971 Adamson et al. ..... 377/18
3,960,079 A * 6/1976 Capetti ..... 101/232
4,057,014 A * 11/1977 Thomas ..... 101/228
4,137,845 A * 2/1979 Jeschke ..... 101/248
4,309,945 A * 1/1982 Marion ..... 101/247
4,545,518 A * 10/1985 Bergland ..... 226/139
4,782,752 A * 11/1988 Etchell ..... 101/248
4,953,461 A * 9/1990 Gaffney et al. ..... 101/142
5,005,479 A * 4/1991 Lewis et al. ..... 101/467
5,085,143 A * 2/1992 Becker ..... 101/183
5,159,878 A * 11/1992 Donelan et al. ..... 101/217
5,163,368 A * 11/1992 Pensavecchia et al. ..... 101/136
5,235,914 A * 8/1993 Williams et al. ..... 101/467
5,237,923 A * 8/1993 Williams et al. ..... 101/467
5,295,753 A * 3/1994 Godo et al. ..... 400/612
5,562,031 A * 10/1996 Garner et al. ..... 101/148
5,651,314 A * 7/1997 Gentle ..... 101/248
5,791,541 A * 8/1998 Jitsuishi et al. ..... 226/40
5,826,505 A * 10/1998 Volz et al. ..... 101/183
5,839,036 A * 11/1998 Shogren ..... 399/213
5,887,526 A * 3/1999 Zahnd ..... 101/486
6,070,529 A * 6/2000 Miller ..... 101/248
6,101,944 A * 8/2000 Schmid et al. ..... 101/467
6,283,467 B1 * 9/2001 Iida ..... 271/82
6,289,805 B1 * 9/2001 Douillard et al. ..... 101/247
6,393,987 B1 * 5/2002 Bolza-Schunemann et al. ..... 101/483

(List continued on next page.)

FOREIGN PATENT DOCUMENTS

DE 44 03 673 A1 8/1995
DE 197 23 147 A1 12/1998

*Primary Examiner*—Andrew H. Hirshfeld
*Assistant Examiner*—Wasseem H. Hamdan
(74) *Attorney, Agent, or Firm*—Laurence A. Greenberg; Werner H. Stemer; Gregory L. Mayback

(57) ABSTRACT

A rotary printing machine includes at least one form cylinder, at least one further cylinder, and a gear transmission via which the form cylinder and the further cylinder are drivable together during a printing operation. A device is provided for setting an image on a printing form located on the form cylinder. A switchable speed-change gear mechanism is disposed between the form cylinder and the gear transmission for driving the form cylinder during the printing operation.

8 Claims, 4 Drawing Sheets

U.S. PATENT DOCUMENTS 6,446,556 B1 * 9/2002 Ida ..... 101/484
6,684,774 B2 * 2/2004 Wadlinger et al. ..... 101/216
2003/0205153 A1 * 11/2003 Wadlinger et al. ..... 101/247

* cited by examiner

ROTARY PRINTING PRESS HAVING A SWITCHABLE SPEED-CHANGE GEAR MECHANISM WITH PLANT GEARS

CROSS-REFERENCE TO RELATED APPLICATION

This application claims the benefit of Provisional Application No. 60/316,843, filed Aug. 31, 2001.

BACKGROUND OF THE INVENTION

Field of the Invention

The invention relates to a rotary printing press including at least one integrated imaging or image-setting device for a printing form which, during imaging or image setting, is fastened to a form cylinder driven rotatably relative to the imaging or image-setting device.

A printing press of that general type is described in German Published, Non-Prosecuted Patent Application DE 197 23 147 A1, corresponding to U.S. Pat. No. 6,393,987. This printing press has two different drive systems. During the printing operation, all components of the printing press required for printing, which are mutually coupled via a gear train, are driven by a main drive. During the imaging or image-setting operation, the form cylinder is driven separately by an auxiliary drive, the main drive being inactivated and the form cylinders being decoupled from the gear train with the aid of decoupling clutches. Deactivation of the main drive is necessary in order to prevent mechanical oscillations or vibrations and impacts, which would otherwise occur during the operation of the main drive, from influencing the imaging system made up of the imaging device and form cylinders. The mechanical vibrations and impacts would cause imaging and printing errors, respectively. During imaging, it is possible, besides driving the form cylinder with the aid of an auxiliary drive, also therewith to drive components which cause only small mechanical oscillations. After imaging, the form cylinder must be coupled into the main drive train or loop in the correct or proper phase, for which special precautions must be taken. The in-phase reintegration of the form cylinder into the gear train can be monitored by measuring systems or performed by mechanical elements such as phase clutches or couplers.

In order to prevent printing errors, German Published, Non-Prosecuted Patent Application DE 44 03 673 A1 teaches how to compensate for mechanical oscillations or vibrations of the printing press during imaging, by corrective controlling of the imaging heads in the circumferential direction.

SUMMARY OF THE INVENTION

It is accordingly an object of the invention to provide a rotary printing machine which overcomes the hereinaforementioned disadvantages of the heretofore-known devices of this general type and which has a low expenditure for material and cost when driving a form cylinder during printing and image-setting operation.

With the foregoing and other objects in view, there is provided, in accordance with the invention, a rotary printing machine, comprising at least one form cylinder, at least a further cylinder, and a gear transmission, via which, during a printing operation, the form cylinder and the further cylinder are drivable together. A device is provided for setting an image on a printing form located on the form cylinder. A switchable speed-change gear mechanism is disposed between the form cylinder and the gear transmission for driving the form cylinder during the printing operation.

In accordance with another feature of the invention, the speed-change gear mechanism is a gear mechanism with planet gears.

In accordance with a further feature of the invention, the speed-change gear mechanism is an epicyclic gear mechanism with planetary spur gears, a central gear having internal teeth and being toothed externally. The externally toothed central gear has a fixed-point ring gear located at a side thereof which, by being displaced on the shaft of the form cylinder, is couplable with like phase into a sidewise-lying fixed-point ring gear of the internally toothed central gear.

In accordance with an added feature of the invention, the rotary printing machine further comprises an adjusting element to which the inner central gear is coupled for displacing the inner central gear, and a key, together with an axial longitudinal groove formed in the central gear, forming a drive connection to the shaft of the form cylinder.

In accordance with an additional feature of the invention, the adjusting element is an operating cylinder.

In accordance with yet another feature of the invention, the speed-change gear mechanism has a transmission ratio matching a natural oscillation range of the rotary printing machine.

In accordance with a concomitant feature of the invention, the speed-change gear mechanism is connectable automatically with a high transmission ratio when the rotary printing machine is switched from printing operation to image-setting operation.

The use of a speed-change gear mechanism between the form cylinder and the gear transmission driving the form cylinder during the printing operation, offers the advantage that during the setting of an image on the printing form, the rotary printing machine is driven in a noncritical oscillation ranger. However, the form cylinder is driven, in accordance with the transmission ratio of the speed-change gear mechanism, at a multiple of the rotational speed of the remaining components in the drive train of the rotary printing machine, for the purpose of setting an image. Depending upon the natural oscillation characteristics of the rotary printing machine, the speed-change gear mechanism may be constructed with different transmission ratios. The remaining rotational oscillations in the drive train and the effects thereof on the image-setting process are rather slight, because of the low rotational speed. As a result, the image-setting quality can be increased. The drive gear train does not have to be isolated for the image-setting operation. A dedicated drive for the form cylinder during image setting or imaging is not required. The speed-change gear mechanism can be engaged and disengaged, respectively, automatically before and after, respectively, the setting of an image. The form cylinder can be coupled with a rotary encoder, which supplies the current or actual rotational speed and the cylinder position to an electronic control system during the setting of an image.

Other features which are considered as characteristic for the invention are set forth in the appended claims.

Although the invention is illustrated and described herein as embodied in a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
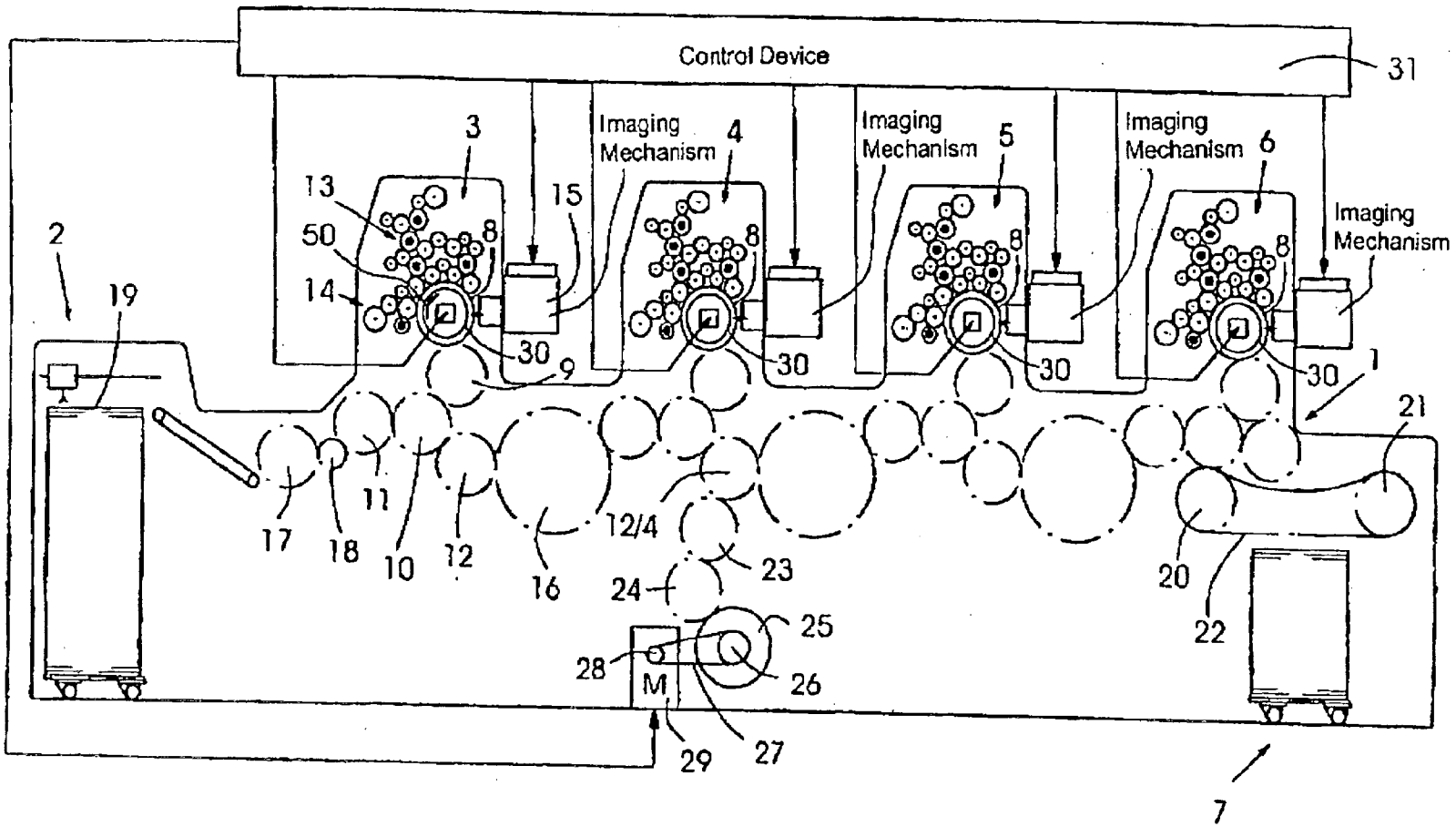
FIG. 1 is a diagrammatic, side-elevational view of a four-color rotary printing press.

Referring now to the figures of the drawings in detail and, first, particularly to FIG. 1 thereof, there is seen a sheet-fed rotary printing press 1 having a feeder 2, four printing units 3, 4, 5 and 6, and a delivery 7. Each printing unit 3 to 6 has a form cylinder 8, a transfer cylinder 9, an impression cylinder 10, two transfer cylinders 11 and 12, a multiplicity of ink transfer rollers 13 and dampening-solution transfer rollers 14, as well as imaging mechanisms 15. Transfer rollers 16 are disposed between the printing units 3 to 6. Additional cylinders 17 and 18 serve for feeding sheets 19 to the first printing unit 3. Deflection cylinders 20 and 21 are located in the delivery 7, with chains 22 of a chain gripper system looped about the cylinders 20 and 21. The cylinders and rollers in the printing units 3 to 6, as well as all rotatably driven cylinders and drums, respectively, in the feeder 2 and the delivery 7, respectively, are connected to one another by a gear transmission or train. An additional gear train 23 to 25 meshes with the gear of the transfer cylinder 12 of the second printing unit 4. A pulley 26 of a belt drive 27 is located on the shaft of the gear 25. A second pulley 28 is seated on the shaft of a main drive motor 29. The main drive motor 29 and the auxiliary drive motors 30 are connected to a control device 31 of the sheet-fed rotary printing press 1. Besides additional actuators and sensors, the imaging mechanisms 15 are also connected to the control device 31.

During the printing operation, sheets 19 are transported from the feeder 2 to the delivery 7 through the printing units 3 to 6, the main drive motor 29 driving all of the components via the gear transmission or train. Harmonic and non-harmonic oscillations occur during the driving of the sheet-fed printing press 1 due to eccentricities, imbalance, and reciprocating assemblies, such as oscillation grippers or gripper mechanisms. The effects of the oscillations and impacts on the print quality are ameliorated by the high pressure exerted between the transfer cylinders 9 and the respective impression cylinders 10 during the printing operation.

In order to avoid circumferential and axial oscillations during the imaging operation, the form cylinders 8 are driven by the auxiliary drive motors 30. The transfer cylinders 9 are disengaged from the form cylinders 8 and the printing cylinders 10 during the printing operation.

Figure 2B:
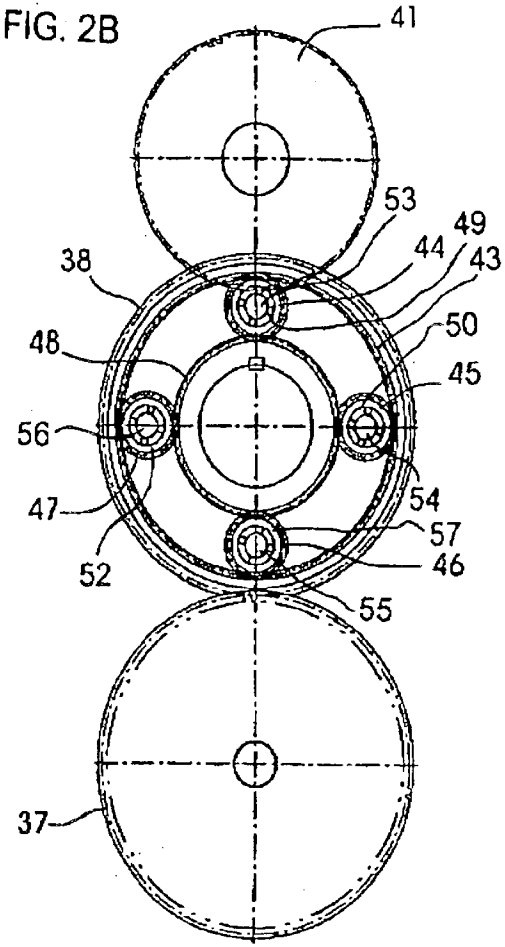
FIG. 2*b* is an end view of the drive shown in FIG. 2*a;*
Figure 2A:
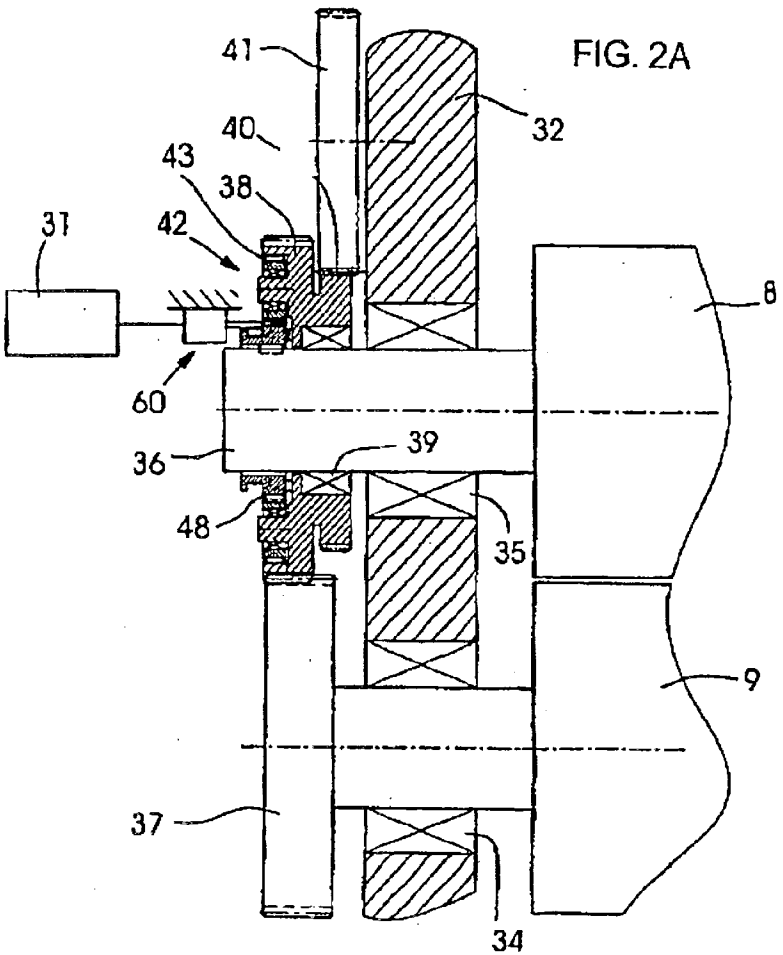
FIG. 2*a* is a cross-sectional view of a drive for a form cylinder of the printing press.
Figure 3:
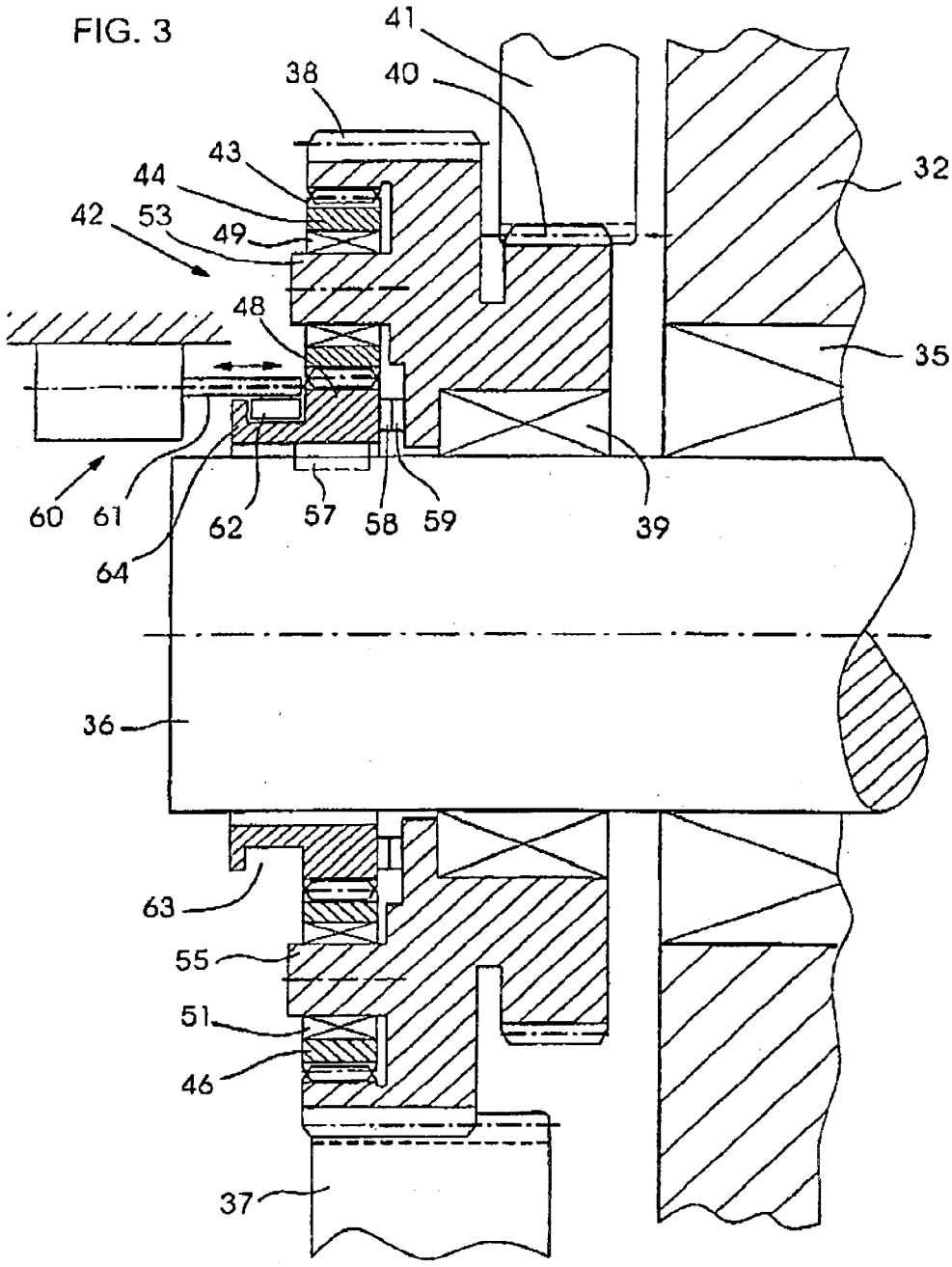
FIG. 3 is an enlarged, fragmentary view of FIG. 2*a* showing an epicyclic gear mechanism therein during a printing operation.

FIGS. 2*a*, 2*b* and 3 represent, with reference to the printing unit 3, how the form cylinders 8 are driven during the printing and the imaging operations. FIG. 2*a* shows a side wall 32 of the sheet-fed rotary printing press 1. The side wall 32 is formed with openings accommodating bearings 33 and 34 for receiving shaft journals 35 and 36, respectively, of the form cylinder 8 and the transfer cylinder 9. A gear 37 of the gear train or transmission for driving the transfer cylinder 9 during printing is fixed on the shaft journal 35. A gear 38 rotates on a bearing 39 mounted on the shaft journal 36. The gear 38 is structurally united with an additional gear 40 for driving an inking and dampening unit. The gear 38 is in continuous meshing engagement with the gear 37, and the gear 40 continuously meshes with another gear 41.

Also assigned to the gear 38 is an epicyclic gear mechanism 42. The epicyclic gear mechanism 42 comprises an internally toothed gear 43, four uniformly distributed planet gears 44 to 47 and an internally located central gear 48. The gear 43 is formed on an outer surface of a section turned down out of the gear 38. The planet gears 44 to 47 are connected to the gear 43 and the gear 48. The planet gears 44 to 47 run in bearings 49 to 52, which are fixed to bolts 53 to 56, which are, in turn, fixed to the turned-down portion of the gear 38. The central gear 48 is connected to the shaft journal 36 by a key 57 and is displaceable in axial direction on the shaft journal 36. The central gear 48 furthermore has a lateral ring gear 58, to which a lateral ring gear 59 formed on the gear 38 is assigned. In order to displace the gear 48 in the axial direction, a fixed-position pull magnet 60 is provided. On a pull armature 61 thereof, there is a roller 62 which engages in a circumferential groove 63 that is machined in a connecting piece 64 on the gear 48.

During a printing operation, the pull magnet 61 with the roller 62 is in a position thereof shown in FIG. 3. The ring gear 58 is engaged with the ring gear 59. If the gears 37 and 38 are set into rotation via the main drive motor 29 and the gear train, the torque is transmitted to the form cylinder 8 via the ring gears 59 and 58, the key 57 and the shaft journal 36. Because the ring gears 58 and 59 are engaged, the epicyclic gear mechanism 42 is blocked. The rotational speed of the form cylinder 8 is provided or determined, respectively, by the numbers of teeth and diameters of the gears 37 and 38.

Figure 4:
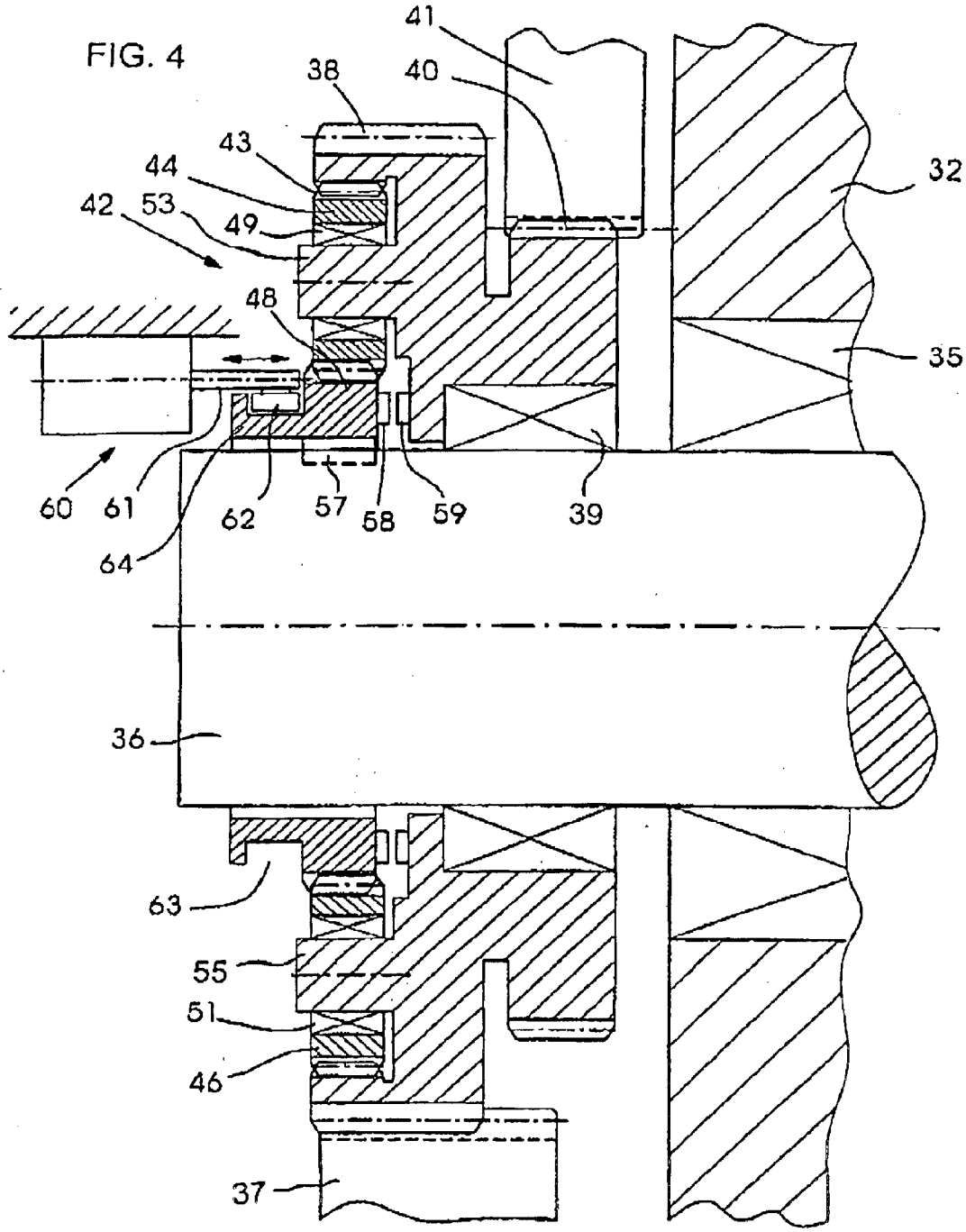
FIG. 4 is a view similar to that of FIG. 3 showing the epicyclic gear mechanism during an image-setting or imaging operation.

During an image-setting or imaging operation, the pull armature 61 with the roller 62 is in the position shown in FIG. 4. The ring gears 58 and 59 are disengaged. When the gear 38 is driven via the gear 37, the planet gears 44 to 47 run around the central gear 38. The rotational speed of the gear 48 and of the form cylinder 8 is increased by a multiple of the input rotational speed at the gear 43, in accordance with the radii of the gears 43, 44 to 47, and 48. Therefore, the gears disposed upstream of the gears 38 and 37 in the drive train can be operated with a low rotational speed, so that very few or no mechanical disturbances on the systems comprising the image-setting devices 15 and the form cylinders 8 are produced.

The invention is not restricted to the epicyclic gear mechanism illustrated in the exemplary embodiment and having the fixed-point ring gears 58 and 59. Any desired speed-change gear mechanism can be used which has the effect that, during the image-setting operation, the drive train is operated in a rotational speed range wherein no disruptive oscillations or shocks occur. In this regard, the transmission ratio of the speed-change gear mechanism can be matched to the natural oscillation range of the rotary printing machine.

The control device 31 serves for controlling the main drive motor 29, the pull magnet 60 or a similar adjusting device, and for controlling the image-setting devices 15. The control device 31 can contain a program which has the effect that the speed-change gear mechanism 30 is automatically connected in or activated with a higher transmission ratio when the rotary printing machine 1 is switched from the printing operation to the image-setting operation.

What is claimed is:

1. A rotary printing machine, comprising:

at least one form cylinder;

at least one further cylinder;

a gear transmission for driving said form cylinder together with said at least one further cylinder during a printing operation;

a device for setting an image on a printing form located on said form cylinder; and a switchable speed-change gear mechanism with planet gears disposed between said form cylinder and said gear transmission for driving said form cylinder during the printing operation.

2. The rotary printing machine according to claim 1, wherein said form cylinder has a shaft, said speed-change gear mechanism is an epicyclic gear mechanism with planetary spur gears, an internally-toothed gear having a laterally-disposed fixed-point ring gear and an externally-toothed central gear, said externally-toothed central gear having a laterally-disposed fixed-point ring gear to be coupled, by being displaced on said shaft of said form cylinder, with like phase into said fixed-point ring gear of said internally-toothed gear.

3. The rotary printing machine according to claim 2, which further comprises an adjusting element coupled to said central gear for displacing said central gear, and a key forming a drive connection to said shaft of said form cylinder, together with an axial longitudinal groove formed in said central gear.

4. The rotary printing machine according to claim 3, wherein said adjusting element is an operating cylinder.

5. The rotary printing machine according to claim 1, wherein said speed-change gear mechanism has a transmission ratio matching a natural oscillation range of the rotary printing machine.

6. The rotary printing machine according to claim 1, wherein said speed-change gear mechanism is to be connected automatically with a high transmission ratio upon switching the rotary printing machine from printing operation to image-setting operation.

7. A rotary printing machine, comprising:

at least one form cylinder having a shaft journal;

at least one further cylinder;

a gear transmission for driving said form cylinder together with said at least one further cylinder during a printing operation;

a device for setting an image on a printing form located on said form cylinder; and a switchable speed-change gear mechanism with planet gears disposed on said shaft journal of said form cylinder between said form cylinder and said gear transmission.

8. A rotary printing machine, comprising:

at least one form cylinder;

at least one further cylinder;

a gear transmission for driving said form cylinder together with said at least one further cylinder during a printing operation;

a device for setting an image on a printing form located on said form cylinder; and a switchable speed-change gear mechanism with planet gears disposed between said form cylinder and said gear transmission, said switchable speed-change gear mechanism driving said form cylinder during an imaging operation.

* * * * *